United States Patent [19]

Knight, Jr.

[11] Patent Number: 4,830,282

[45] Date of Patent: May 16, 1989

[54] CONTAINER TOP CLOSURE ARRANGEMENT

[75] Inventor: Onis A. Knight, Jr., Hurst, Tex.

[73] Assignee: Container Corporation of America, Clayton, Mo.

[21] Appl. No.: 205,092

[22] Filed: Jun. 13, 1988

[51] Int. Cl.[4] ..... B65D 5/06

[52] U.S. Cl. ..... 229/135; 229/143; 229/152

[58] Field of Search ..... 229/132, 133, 135, 136, 229/143, 152

[56] References Cited

U.S. PATENT DOCUMENTS

| | | | |
|---|---|---|---|
| 2,276,820 | 3/1942 | Bonfield | 229/143 |
| 2,329,628 | 9/1943 | Lanigan | 229/135 |
| 2,652,970 | 9/1953 | George | 229/143 |
| 2,713,964 | 7/1955 | Repking et al. | 229/143 |
| 3,221,974 | 12/1965 | Scholle | 229/135 |
| 3,263,896 | 8/1966 | Woolsey | 229/135 |
| 3,268,149 | 8/1966 | Brackett | 229/135 |
| 3,586,233 | 6/1971 | McCulloch | 229/143 |

FOREIGN PATENT DOCUMENTS

| | | | |
|---|---|---|---|
| 661754 | 11/1951 | United Kingdom | 229/132 |
| 1184175 | 3/1970 | United Kingdom | 229/132 |

*Primary Examiner*—David T. Fidei
*Assistant Examiner*—Gary E. Elkins
*Attorney, Agent, or Firm*—Richard W. Carpenter

[57] ABSTRACT

A top closure arrangement for a container having opposed pairs of major and minor side wall panels forming a tubular structure and including opposed pairs of inner and outer closure flaps joined to upper end edges of the side wall panels with the inner closure flaps each having foldably joined to opposite sides thereof support tabs formed from material cut from adjacent portions of said outer closure flaps and folded downwardly for engagement with adjacent surfaces of related side wall panels to help support the inner closure flaps when they are in a closed position.

6 Claims, 1 Drawing Sheet

CONTAINER TOP CLOSURE ARRANGEMENT

BACKGROUND OF THE INVENTION

1. Field of the Invention

This invention relates to paperboard containers, and more particularly to a top closure arrangement, for a paperboard conatiner, that includes overlapping closure flaps certain of which have support tabs joined thereto for engagement with upper portions of the side walls of the container.

2. Description of Background Art

A background art search directed to the subject matter of this application in the United States Patent and Trademark Office disclosed the following United States Letters Patent: 2,187,304; 2,329,628; 2,276,820; 2,415,869; 2,652,970; 2,713,964; 2,729,385; 2,769,589; 2,835,431; 3,221,974; 3,586,233; 3,581,973.

None of the patents uncovered in the search discloses a container top closure arrangement that includes overlapping pairs of inner and outer flaps wherein the inner flaps have foldably joined to side edges thereof support tabs formed from material cut from adjacent portions of the outer closure flaps and that are adapted to engage upper portions of side walls of the container to support the inner closure flaps and prevent them from being depressed into the container when the container is not completely filled.

SUMMARY OF THE INVENTION

It is an object of the present invention to provide an improved closure arrangement for a one-piece paperboard container.

It is another object of the invention to provide a container top closure arrangement wherein certain of the closure flaps have supporting tabs adapted to prevent the closure flaps from being pushed or deflected into the container when the container is not completely filled.

A more specific object of the invention is the provision of a container top closure flap arrangement wherein the inner flaps are provided with integral support tabs foldably joined to the side edges thereof and adapted to engage upper portions of side walls of the container to keep the closure flaps in proper position when the container is not completely filled.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

In the packaging of certain types of products, when a container holding the product is not completely filled, the top closure flaps of the container tend to be forced inwardly, especially when the container is stacked with other filled containers.

This occurs when the products, for instance, are hot injection molded items which are packed in a hot condition and which shrink when cooled to room temperature.

This also occurs when a container is filled with some types of particulate material that settles after the container has been filled.

The purpose of this invention is to provide a closure arrangement wherein the closure flaps are self supporting to prevent the deflection or depression of the closure flaps into the body of the container.

Figure 1:
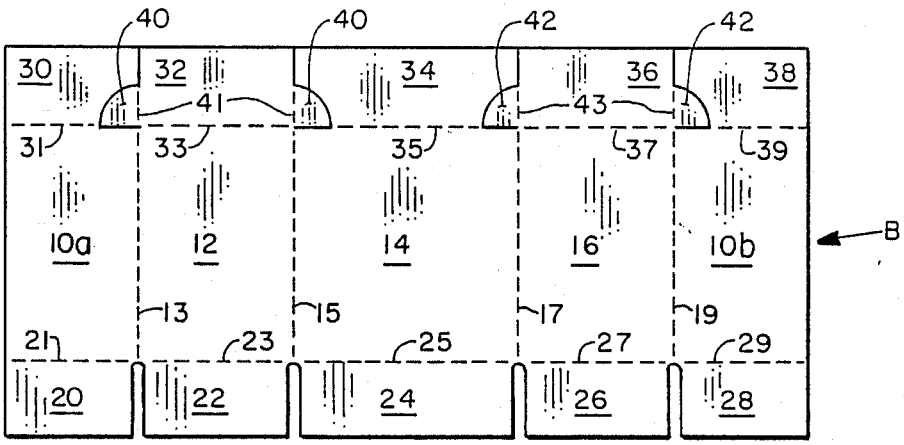
FIG. 1 is a plan view of a blank of foldable sheet material from which the container illustrated in the other views may be formed.
Figure 2:
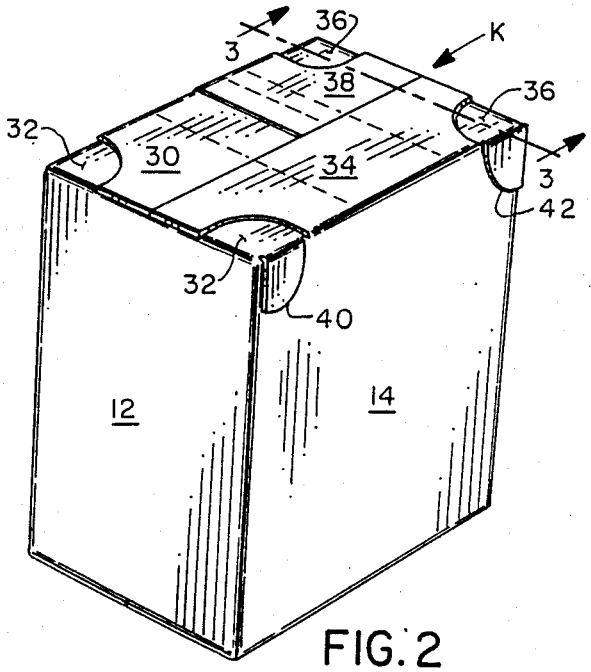
FIG. 2 is a fragmentary perspective view of an erected container embodying features of the present invention.
Figure 3:
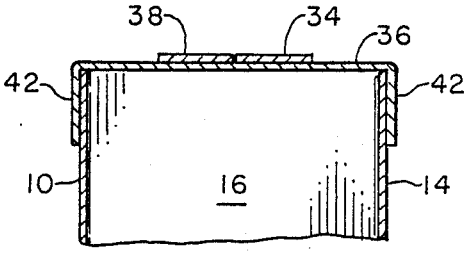
FIG. 3 is a fragmentary, transverse, vertical, sectional view taken on line 3—3 of FIG. 2.

The container K illustrated in the FIGS. 2–6 of the drawings may be formed from the unitary blank B of foldable sheet material, such as paperboard, illustrated in FIG. 1.

Referring to FIG. 1, it will be seen that the body of the container includes a first major side wall panel first sectoin **10*a*, a first minor side wall panel 12, a second major side wall panel 14, a second minor side wall panel 16, and a first major side wall panel second section 10*b*, which are foldabley joined to each other along parallel fold lines 13, 15, 17, and 19, respectively, with portions of first major side wall panel first and second sections 10*a* and 10*b*** secured to each other in overlapping relation to form a tubular body structure which is open at the upper and lower ends.

The lower end of the body structure may be closed in a convention manner by a plurality of bottom closure flaps that include flaps 20, 22, 24, 26, and 28, which are joined along fold lines 21, 23, 25, 27, and 29, to the lower ends of panels **10*a*, 12, 14, 16, and 10*b***, respectively.

At the upper end of the container body there are provided closure flaps 30, 32, 34, 36, and 38, which are foldably joined to the upper ends of panels **10*a*, 12, 14, 16, and 10*b*, along fold lines 31, 33, 35, 37, and 39**, respectively.

Still referring to FIG. 1, it will be seen that a pair of generally pie-shaped support tabs 40 are foldably joined to opposite side edges of closure panel 32 along fold lines 41, which are extensions of fold lines 13 and 15. The support tabs 40 are formed from material cut from panels 30 and 34, which are adjacent to panel 32.

Also, it will be seen that top closure flap 36 also has a pair of generaly pie-shaped support tabs 42 foldably joined to its opposite side edges along fold lines 43, which fold lines are extentions of fold lines 17 and 19. Support tabs 42 are cut from portions of the material of flaps 34 and 38, which are adjacent to closure flap 36.

In erecting the carton, the body is formed into a tube from the collapsed condition, in which the carton is normally shipped, and the bottom closure flaps are folded into overlapping relation and secured to each other in a conventional manner.

After the container has been filled, the top closure flaps are folded into overlapped relation and secured to each other.

In folding the top closure flaps into closed position, the inner closure flaps 32 and 36 are first folded inwardly at right angles to the panels to which they are joined, and then the support tabs 40 and 42 are folded downwardly to overlie the outer surfaces of major side walls 10 and 14. The support tabs are preferrably secured by adhesive means to the outer surfaces of the major side walls. The outer closure flaps 30 and 34 are then folded into overlapping relation with and secured to the outer surfaces of inner flaps 32 and 36 to form a solid cover for the container, wherein the inner flaps are prevented from being deflected inwardly by the support tabs 40 and 42.

Figure 5:
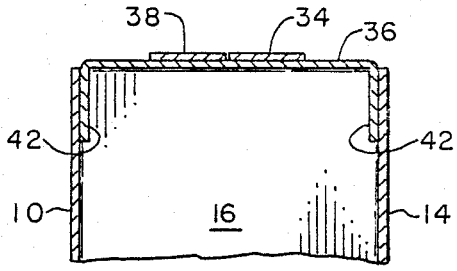
FIGS. 4 and 5 are views similar to those of FIGS. 2 and 3, but illustrate a slightly modified form of the invention.
Figure 4:
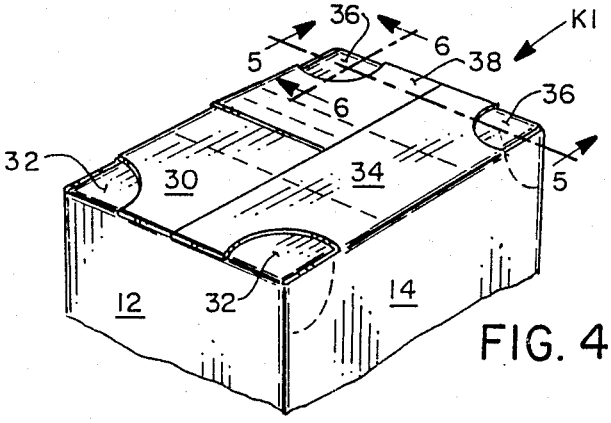
Figure 6:
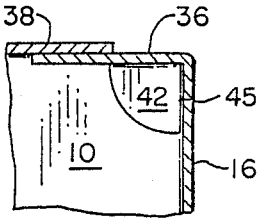
FIG. 6 is a fragmentary longitudinal vertical sectional view taken on line 6—6 of FIG. 4.

Turning now to FIGS. 4–6 of the invention, a slightly modified form of the invention is shown. In this embodiment the physical structure of the container is exactly the same as the previous embodiment, except that support tabs 40 and 42 are folded into the container so as to lie against the inner surfaces of the major side walls 10 and 14, as shown in FIGS. 5 and 6.

As best seen in FIG. 6, the vertical edges 45 of the support tabs 42, as well as the corresponding edge surfaces of the tabs 41, not shown, engage the inner surfaces of related minor wall panels to maintain the inner closure flaps in horizontal position and prevent them from being deflected inwardly into the container.

Thus, it will be appreciated that the invention provides a unique closure arrangement of relatively simple design and construction which affords a positive means for preventing the top closure flaps from being deflected into the carton when the carton is not completely filled from the top to the bottom.

What is claimed is:

1. A top closure arrangement for a container formed from a unitary blank of foldable paperboard and including opposed pairs of major and minor side wall panels foldably joined to each other to form a tubular structure open at the ends, said closure arrangement comprising:

(a) a pair of inner closure flaps foldably joined to upper ends of respective minor side wall panels and folded inwardly therefrom and normal thereto;

(b) a pair of outer closure flaps foldably joined to upper ends of respective major side wall panels and folded inwardly therefrom and normal thereto into overlapping relation with said inner closure flaps;

(c) each of said inner closure flaps having foldably joined to opposite sides thereof support tabs formed from material cut from adjacent portions of said outer closure flaps;

(d) said support tabs being folded downwardly from said inner flaps and normal thereto for engagement with adjacent surfaces of related major side wall panels to help support said inner closure flaps when said flaps are in a closed position;

(e) said support tabs being secured against outer surfaces of said related major side wall panels.

2. A top closure arrangement for a container formed from a unitary blank of foldable paperboard and including opposed pairs of first and second side wall panels foldably joined to each other to form a tubular structure open at the ends, said closure arrangement comprising:

(a) a pair of inner closure flaps foldably joined to upper ends of respective first side wall panels and folded inwardly therefrom and normal thereto;

(b) a pair of outer closure flaps foldably joined to upper ends of respective second side wall panels and folded inwardly therefrom and normal thereto into overlapping relation with said inner closure flaps;

(c) each of said inenr closure flaps having foldably joined to opposite sides thereof support tabs formed from material cut from adjacent portions of said outer closure flaps;

(d) said support tabs being folded downwardly from said inner flaps and normal thereto for engagement with adjacent surfaces of related second side wall panels to help support said inner closure flaps when said flaps are in a closed position;

(e) said support tabs being secured against outer surfaces of said related second side wall panels.

3. A top closure arrangement for a container formed from a unitary blank of foldable paperboard and including opposed pairs of first and second side wall panels foldably joined to each other to form a tubular structure open at the ends, said closure arrangement comprising:

(a) a pair of inner closure flaps foldably joined to upper ends of respective first side wall panels and folded inwardly therefrom and normal thereto;

(b) a pair of outer closure flaps foldably joined to upper ends of respective second side wall panels and folded inwardly therefrom and normal thereto into overlapping relation with said inner closure flaps;

(c) each of said inner closure flaps having foldably joined to opposite sides thereof support tabs formed from material cut from adjacent portions of said outer closure flaps;

(d) said support tabs being folded downwardly from said inner flaps and normal thereto and secured to adjacent surfaces of related second side wall panels to help support said inner closure flaps when said flaps are in a closed position.

4. An arrangement according to claim 3, wherein said support tabs are joined to their respective closure flaps at locations adjacent inner ends of said closure flaps.

5. An arrangement according to claim 3, wherein said support tabs are folded against inner surfaces of related first and second side wall panels.

6. An arrangement according to claim 3, wherein said support tabs are trilateral with one arcuate side.

* * * * *